United States Patent [19]

Woodroffe

[11] Patent Number: 5,026,973

[45] Date of Patent: Jun. 25, 1991

[54] NUMBER WHEEL COUNTERS

[75] Inventor: David Woodroffe, Bedfordshire, Great Britain

[73] Assignee: ABB Kent plc, Luton, Great Britain

[21] Appl. No.: 381,495

[22] PCT Filed: Nov. 14, 1988

[86] PCT No.: PCT/GB88/00993

§ 371 Date: Aug. 28, 1989

§ 102(e) Date: Aug. 28, 1989

[87] PCT Pub. No.: WO89/05016

PCT Pub. Date: Jun. 1, 1989

[30] Foreign Application Priority Data

Nov. 18, 1987 [GB] United Kingdom ..... 8726924

[51] Int. Cl.[5] ..... G06M 1/08

[52] U.S. Cl. ..... 235/136; 235/119; 235/134; 377/82

[58] Field of Search ..... 235/109, 119, 133 R, 235/134, 136; 377/55, 82

[56] References Cited

U.S. PATENT DOCUMENTS

| | | | |
|---|---|---|---|
| 3,019,974 | 2/1962 | Bliss et al. | 235/119 |
| 3,780,524 | 12/1973 | Boyles | 235/134 |
| 3,875,376 | 4/1976 | Kakeno | 235/136 |
| 3,931,705 | 1/1976 | Iwaki et al. | 235/134 |
| 4,257,324 | 3/1981 | Stefansson et al. | 377/55 |

*Primary Examiner*—John S. Heyman

*Attorney, Agent, or Firm*—Wolf, Greenfield & Sacks

[57] ABSTRACT

A number wheel counter has a worm wheel connected with the least significant number wheel. A worm gear engaged with the worm wheel is mounted for both rotational and translational movement about a spindle. Cam means are provided such that as the worm gear is rotated, it is also displaced bodily by the cam means so that the worm wheel remains unmoved. At the end of a defined travel of the cam means, the worm gear is returned rapidly to a rest position driving the worm wheel in the manner of a rack and pinion. In this way the number wheels are driven intermittently with the time interval during which the number wheels are between discreet number positions being minimized.

6 Claims, 1 Drawing Sheet

NUMBER WHEEL COUNTERS

This invention relates to number wheel counters and in a particular example to counters adapted to provide an electrical output.

It is known that the number wheels of generally conventional number wheelcounters can be adapted—for example by providing them with wipers engaging fixed contact arrays—to produce an encoded electrical output signal which is indicative of the counter reading. It is then possible to read such a counter by interrogation over a suitable communication line or through the use of a portable reading unit which is periodically connected to the counter via a suitable interface. Such counters have been proposed for use with meters which measure domestic or industrial water consumption or indeed other public utilities.

It has been recognised as a problem with such counters that the wipers which are connected to the number wheels may actually be between contacts at the instant at which the counter reading is read. This problem arises most frequently with the least significant number wheel although the remaining number wheels will be affected at decade intervals and an error in reading one of the more significant number wheels is of course more serious. One solution that has been proposed to deal with this difficulty is to take counter readings in pairs, and to accept the readings only if they are the same, so confirming that there has been no movement of the number wheels.

In an alternative proposal, a number wheel counter has been Provided in which the number wheels are driven in a stepwise manner rather than continuously, as is the conventional case. In this way the risk of the number wheel wiper being positioned between fixed contacts at the instant of meter reading, is very much reduced. The known mechanisms for achieving this purpose are however bulky and add significantly to manufacturing costs. In addition they frequently impose high torque requirements.

It is an object of this invention to provide an improved number wheel counter which is mechanically simple and compact yet which provides for the number wheels to be moved rapidly from one number position to the next.

Accordingly, the present invention consists in a number wheel counter comprising a plurality of interconnected number wheels; a worm wheel connected with a first one of the number wheels; a worm gear positioned in driving engagement with the worm wheel; and means for rotating the worm gear about its longitudinal axis to effect rotation of the worm wheel and thereby rotation of the first number wheel; wherein there is further provided cam means for displacing the worm longitudinally away from a rest position in synchronism with rotation thereof, such that the worm wheel remains stationary over a worm gear rotation corresponding with a number interval of the first number wheel, and biassing means for restoring the worm gear rapidly to its rest position to drive the first number wheel through a number interval.

Advantageously, the means for rotating the worm gear comprises a gear mounted coaxially and fixed for rotation with the worm gear, said cam means comprising complementary cam surfaces on said gear and on a fixed cam.

The invention will now be described by way of example with reference to the accompanying drawings in which.

Figure 1:
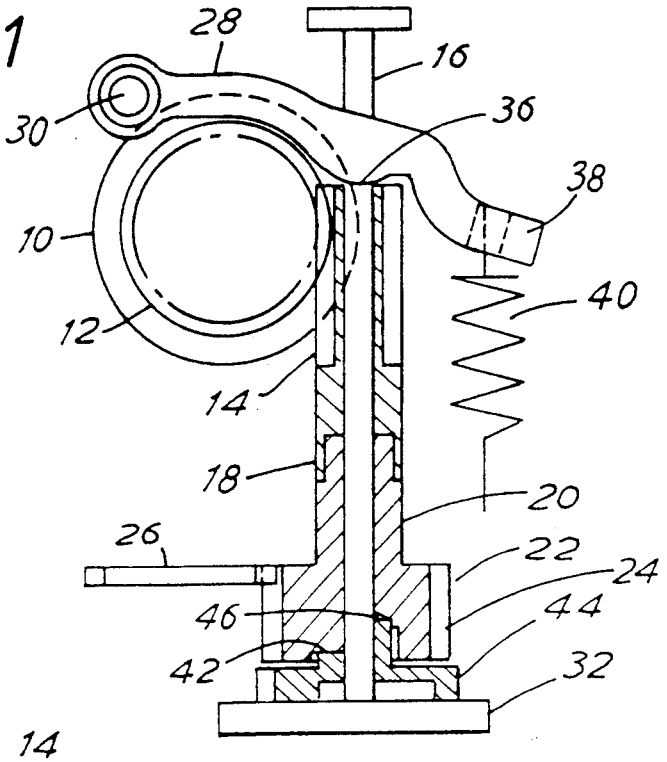
FIG. 1 is a front view, partly in section, of the operative portion of a number wheel counter according to this invention.
Figure 3A:
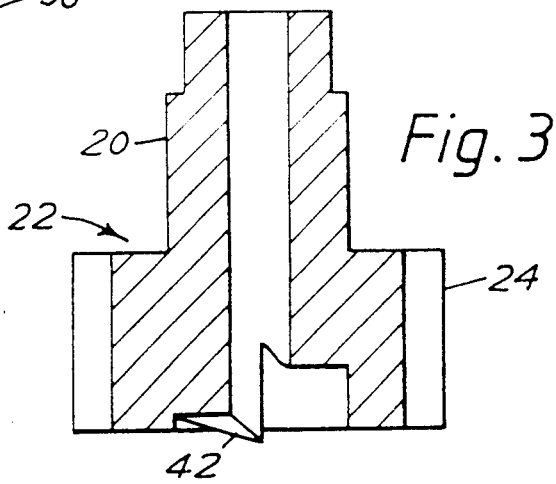

FIG. 3*a* is an enlarged sectional front view of the driven gear shown in FIG. 1.

Figure 3B:
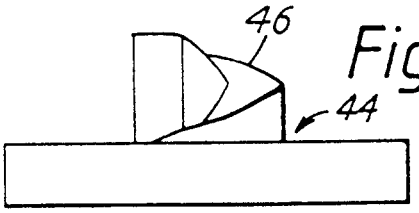

FIG. 3*b* is an enlarged front view of the fixed cam shown in FIG. 1.

Figure 4:
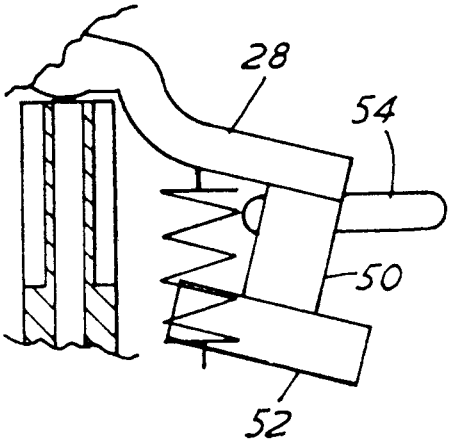

FIG. 4 is a part view similar to FIG. 1, illustrating a modification.

The number wheel counter illustrated in the drawings comprises a bank of coaxial number wheel counters only the least significant of which is shown in the drawings at !0. The remaining number wheels are of conventional form and are driven from the first number wheel 10 through transfer pinions or in any other suitable manner such that a complete revolution of one number wheel drives the next succeeding number wheel through one number interval.

There is fixed to the first number wheel 10 a coaxial worm wheel 12. A hollow worm gear 14 is mounted for sliding movement upon a stationary spindle 16. The worm gear is positioned so as to be in driving engagement with the worm wheel, this driving engagement extending over the entire range of travel of the worm gear 14 along the spindle 16. The lower portion of the worm gear mates through flange 18 with the stub 20 of a driven gear 22. This driven gear has a relatively broad tooth ring 24 engaging a drive gear 26. It will be recognised that the worm gear 14 and driven gear 22 form an integral assembly which can slide over the stationary spindle 16 upwardly from the position shown in FIG. 1. Because of the depth of the tooth ring 24 on the driven gear 22, driving engagement with the drive gear 26 is maintained over this longitudinal travel.

Figure 2:
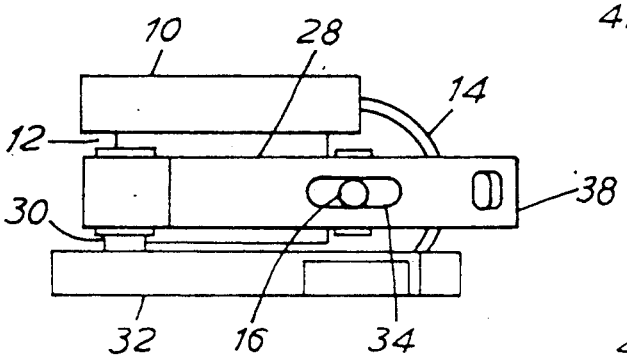
FIG. 2 is a plan view of the part shown in FIG. 1.

The worm gear 14 is biassed towards the position shown in FIG. 1 by means of a lever arm shown generally at 28. The lever arm is pivotally mounted on a pin 30 which projects from the meter housing 32 in a direction parallel to the number wheel axis. The lever arm is provided with a slot 34 (seen best in FIG. 2) through which the spindle 16 extends and the surface of the lever beneath the slot 34 is shaped to provide an abutment 36 engaging the top surface of the worm gear 14. The region of the lever arm between its pivotal mounting and the abutment 36 is curved to conform with the arcuate surface of the worm wheel 12. The free end 38 of the lever engages a tension spring 40, which, as shown schematically in FIG. 1, is connected with the meter housing to urge the lever 28 to the position shown in FIG. 1.

The end surface of the driven gear 22 which is remote from the worm gear 14 is shaped (as best seen in FIG. 3*a*) to provide an internal cam surface 42. This cam surface takes the form of a 180° helical path arranged coaxially with the spindle 16. A fixed cam 44 secured to the meter housing 32 is again disposed coaxially with the spindle 16 and has an external cam surface 46 which (as best seen in FIG. 3*b*) is complementary with the internal cam surface 42 of the driven gear.

The operation of the described mechanism can now be understood.

Rotation of the drive gear 26 in response to a displacement of the meter or other assembly to which the described counter is connected, will effect rotation of the driven gear 22. Because of the interengagement of the cam surfaces 42 and 46 on the driven gear and fixed cam 44 respectively, this rotational movement will be accompanied by a synchronous longitudinal displacement upwardly from the position shown in FIG. 1. The worm gear of course follows these movements. The pitch angle of the helical cam surfaces is so chosen with regard to the pitch of the worm gear 14 that the longitudinal movement of the worm exactly compensates for the driving effect of the worm rotation. The result is that the worm wheel 14 remains entirely stationary. During this period, the first number wheel 10 of course remains in the last effective number wheel position.

As the relative rotation reaches 360°, the helical cam surfaces move out of engagement; the assembly of the worm 14 and driven gear 22 is then forced rapidly back to the rest position shown in FIG. 1 under the action of the spring biassed lever 28. During this movement, the worm gear 14 effects a rotation of the worm wheel essentially acting in the manner of a rack and pinion. The number wheel is in consequence moved very quickly from one number wheel position to the next.

It will be understood that with the arrangement of a wiper connected to the number wheel 10, the time interval over which that wiper may lie between contacts of a fixed array is very much reduced as compared to the time taken to drive the number wheel continuously from one number wheel position to the next. This desirable result is achieved with very few additional components and with only a slight increase in the working space required for the mechanism.

Whilst this invention has particular utility with a number wheel counter having a wiper and contact assembly or other means for providing an encoded electrical output signal, it will also find use in number wheel counters which are only intended to be read visually. In certain circumstances, a number wheel which is seen to be positioned between numbers may cause uncertainty in the reading and preference will be given to a number wheel display which provides an unambiguous reading at substantially all times.

The invention is also useful with a number wheel counter adapted through the use, for example, of a reed switch to provide an electrical pulse at defined counter intervals. It is a problem with magnetically reed switches connected with the pawl of a conventional number wheel counter that the relatively slow actuation of the reed switch can lead to erroneous pulses in the external sensing circuits.

Referring now to FIG. 4, there is illustrated a modified number wheel counter for use in such an application. The lever arm 28 is provided with an extension 50 which carries a permanent magnet 52. This permanent magnet is associated with a fixed reed switch 54. During the relatively slow upward movement of the lever arm 28, the permanent magnet approaches the reed switch to close the contacts. As, in the manner described above, the worm gear 14 is forced rapidly back to its rest position, the permanent magnet is similarly moved rapidly away from the reed switch so as to provide clean opening of the reed switch contacts.

It should be understood that this invention has been described by way of example only and a wide variety of modifications may be made to the described arrangement without departing from the scope of the invention. For example, alternative mechanisms could be employed for biassing the worm gear to its rest position, one example being a simple compression spring on the stationary spindle. Similarly, the worm may be mounted for rotational and longitudinal movement in ways other than that described. A spindle could for example be formed integrally with the worm. The skilled man will also recognise that the described cam arrangement is only one of a wide variety of mechanisms which will provide for longitudinal displacement of the worm in synchronism with rotation through a specified interval.

I claim:

1. A number wheel counter comprising a plurality of interconnected number wheels; a worm wheel connected with a first one of the number wheels; a worm gear positioned in driving engagement with the worm wheel; and means for rotating the worm gear about its longitudinal axis to effect rotation of the worm wheel and thereby rotation of the first number wheel; wherein there is further provided cam means for displacing the worm gear longitudinally away from a rest position in synchronism with rotation thereof, such that the worm wheel remains stationary over a worm gear rotation corresponding with a number interval of the first number wheel, and biassing means for restoring the worm gear rapidly to its rest position to drive the first number wheel through a number interval.

2. A counter according to claim 1, wherein the means for rotating the worm gear comprises a gear mounted co-axially of and fixed for rotation with the worm gear, said cam means comprising complementary cam surfaces on said gear and on a fixed cam.

3. A counter according to claim 2, wherein said gear is provided with teeth that extend a sufficient distance in said longitudal axis to remain continuously in contact with the teeth of a fixed drive gear.

4. A counter according to any one of the preceding claims in which the worm gear is hollow and mounted for rotational and translational movement about a coaxial fixed spindle.

5. a counter according to claim 1 wherein said biasing means comprises a pivotal lever arm engaging the worm gear.

6. A counter according to claim 5 wherein said lever arm is provided with a magnetic element for operation of a reed switch.

* * * * *